US012083388B2

(12) United States Patent
Shinohara

(10) Patent No.: US 12,083,388 B2
(45) Date of Patent: Sep. 10, 2024

(54) GOLF BALL INCLUDING DELUSTERANT AND METHOD FOR PRODUCING THE SAME

(71) Applicant: BRIDGESTONE SPORTS CO., LTD., Tokyo (JP)

(72) Inventor: Hirotaka Shinohara, Chichibu (JP)

(73) Assignee: BRIDGESTONE SPORTS CO., LTD., Tokyo (JP)

( * ) Notice: Subject to any disclaimer, the term of this patent is extended or adjusted under 35 U.S.C. 154(b) by 0 days.

(21) Appl. No.: 17/726,911

(22) Filed: Apr. 22, 2022

(65) Prior Publication Data

US 2022/0401796 A1 Dec. 22, 2022

(30) Foreign Application Priority Data

Jun. 21, 2021 (JP) ..... 2021-102574

(51) Int. Cl.
*A63B 37/06* (2006.01)
*A63B 37/00* (2006.01)

(52) U.S. Cl.
CPC ..... *A63B 37/00222* (2020.08); *A63B 37/00221* (2020.08)

(58) Field of Classification Search
CPC ..... A63B 37/0022; A63B 37/0023
See application file for complete search history.

(56) References Cited

U.S. PATENT DOCUMENTS

2006/0030428 A1* 2/2006 Ohira ..... A63B 37/00065 473/378
2009/0025870 A1* 1/2009 Tanaka ..... C08F 292/00 156/273.3
2012/0302376 A1* 11/2012 Fitchett ..... A63B 45/00 473/378
2018/0093137 A1* 4/2018 Park ..... C08G 18/792
2020/0001139 A1* 1/2020 Shinohara ..... C09D 175/06

FOREIGN PATENT DOCUMENTS

JP 2020-000624 A 1/2020

* cited by examiner

*Primary Examiner* — Raeann Gorden
(74) *Attorney, Agent, or Firm* — Sughrue Mion, PLLC

(57) ABSTRACT

A golf ball according to the present invention includes a core, a cover located outside the core and having a plurality of dimples, and a coating layer located outside the cover and containing a delusterant, the surface of the coating layer having an average roughness Ra of at least 0.35. The surface of the golf ball has a static friction coefficient of at least 0.20. A method for producing a golf ball according to the present invention includes forming a coating layer on the surface of a cover having a plurality of dimples by using a coating material composition including a polyurethane coating material, a delusterant, and a solvent having a boiling point of at least 130° C.

4 Claims, 2 Drawing Sheets

GOLF BALL INCLUDING DELUSTERANT AND METHOD FOR PRODUCING THE SAME

CROSS-REFERENCE TO RELATED APPLICATION

This application claims priority from Japanese Patent Application No. 2021-102574 filed Jun. 21, 2021, which is incorporated herein by reference in its entirety.

BACKGROUND OF THE INVENTION

The present invention relates to a golf ball including a delusterant, and relates to a method for producing the same.

In recent years, many delustered golf balls with a matte coating have been commercialized for high quality and visibility. For these types of golf balls, a usual approach is to incorporate a delusterant into the coating layer, which is the outermost layer of the golf ball, to emboss the surface of the golf ball to give a matte appearance.

For example, JP 2020-000624 A discloses a golf ball prepared by incorporating a delusterant having a BET specific surface area of 200 to 400 $m^2/g$ and an average primary particle size of 1.0 to 3.0 μm into the coating layer, which is the outermost layer of the golf ball, so that the surface of the coating layer has an average roughness Ra of 0.5 to 1.0.

SUMMARY OF INVENTION

However, when the coating layer is formed from a coating material containing a delusterant, the surface roughness of the surface of the golf ball is increased compared with a coating layer formed from a coating material not containing a delusterant. Thus, there is a problem in that the surface is slippery, and the backspin rate of the golf ball in approach shots is significantly reduced, and the spin rate is insufficient.

In consideration of this problem, an object of the present invention is to provide a golf ball having a lusterless appearance with a coating layer containing a delusterant and having excellent spin properties in approach shots, and to provide a method for producing the same.

In order to achieve the object, one aspect of the present invention provides a golf ball including: a core; a cover located outside the core and having a plurality of dimples; and a coating layer located outside the cover and containing a delusterant, a surface of the coating layer having an average roughness Ra of at least 0.35, of which a surface has a static friction coefficient of at least 0.20.

The surface of the golf ball may have a static friction coefficient of at least 0.24.

The surface of the golf ball may have a surface energy of at least 40 dyn.

The delusterant may be silica having a hydrophilic treated surface.

The coating layer may have an edge ratio of up to 70%, the edge ratio being a ratio of a thickness of the coating layer in an edge portion of a dimple to a thickness of the coating layer in a central portion of the dimple.

The coating layer may include a urethane coating material. The urethane coating material may include polyisocyanate as a curing agent. The polyisocyanate may include both an adduct form and an isocyanurate form of hexamethylene diisocyanate.

Another aspect of the present invention provides a method for producing a golf ball, including: forming a coating layer on a surface of a cover having a plurality of dimples by using a coating material composition including a polyurethane coating material, a delusterant, and a solvent having a boiling point of at least 130° C., so that a surface of the coating layer has an average roughness Ra of at least 0.35, and a surface of the golf ball has a static friction coefficient of at least 0.20.

The solvent may include propylene glycol monomethyl ether acetate or methoxybutyl acetate.

As described above, the present invention provides a golf ball having a lusterless appearance and having excellent spin properties in approach shots, by forming a coating layer containing a delusterant on the surface of a cover having a plurality of dimples and setting the static friction coefficient on the surface of the golf ball to at least 0.20 even when the surface of the coating layer has an average roughness Ra of at least 0.35, and a method for producing the same.

DESCRIPTION OF PREFERRED EMBODIMENTS

Figure 1:
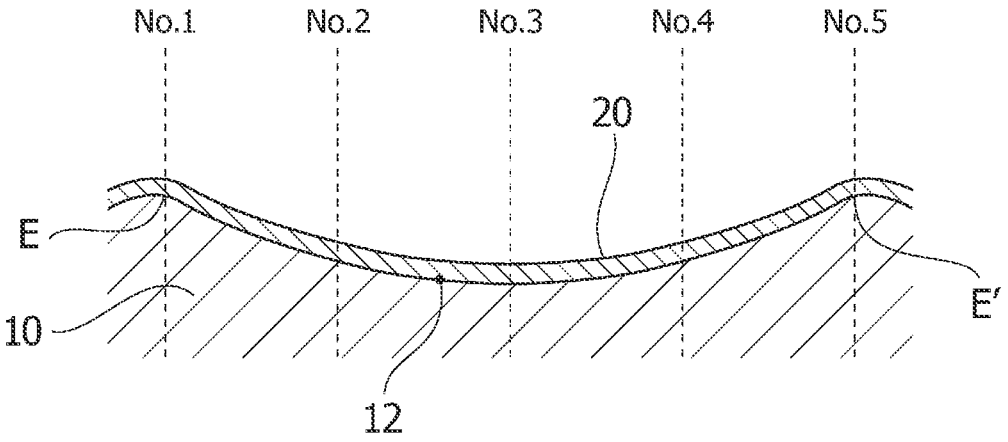
FIG. 1 is a cross-sectional view schematically showing a peripheral part of a dimple in an embodiment of a golf ball according to the present invention.

Hereinafter, embodiments of a golf ball according to the present invention and a method for producing the same will be described with reference to the accompanying drawings.

The golf ball according to the present embodiment mainly includes a core which is located in the center of the ball, a cover which is provided on the outside of the core and on which a plurality of dimples is formed, and a coating layer which is provided on the outside of the cover and which contains a delusterant. A golf ball having a two-layer structure of a core and a cover will be described in the present embodiment, but the present invention is not limited thereto. The golf ball may have an intermediate layer between the core and the cover, and the golf ball may also have a multilayered core having two or more layers. The elements of the golf ball of the present embodiment will be described.

The core may be primarily formed of a base rubber. As the base rubber, a wide variety of rubbers (thermosetting elastomers) may be used. For example, a polybutadiene rubber (BR), a styrene-butadiene rubber (SBR), a natural rubber (NR), a polyisoprene rubber (IR), a polyurethane rubber (PU), a butyl rubber (IIR), a vinyl polybutadiene rubber (VBR), an ethylene-propylene rubber (EPDM), a nitrile rubber (NBR), and a silicone rubber may be used, but the base rubber is not limited thereto. As the polybutadiene rubber (BR), for example, 1,2-polybutadiene and cis-1,4-polybutadiene and the like can be used.

A co-cross-linking agent, a cross-linking agent, a filler, an antiaging agent, an isomerization agent, a peptizer, sulfur, and an organosulfur compound may be optionally added to the core in addition to the base rubber, which is the main component. Furthermore, a thermoplastic elastomer, an ionomer resin, or a mixture thereof may be used as the main component instead of the base rubber.

The core has a substantially spherical shape. The upper limit of the outer diameter of the core is preferably about 42 mm, more preferably about 41 mm, and further preferably about 40 mm. The lower limit of the outer diameter of the core is preferably about 5 mm, more preferably about 15 mm, and most preferably about 25 mm. The core may be solid or be hollow. The core may be a single layer, or it may be composed of a plurality of layers including a center core and a layer surrounding the center core.

The cover may be formed by using thermoplastic polyurethane, an ionomer resin, or a mixture thereof, but the material of the cover is not limited thereto.

The thermoplastic polyurethane has a structure composed of a soft segment of a polymer polyol (polymeric glycol) and a hard segment comprised of a chain extender and polyisocyanate. Polymer polyol, which is the raw material, is not particularly limited, and it is preferably a polyester polyol and a polyether polyol in the present invention. Specific examples of polyester polyols include adipate polyols such as polyethylene adipate glycol, polypropylene adipate glycol, polybutadiene adipate glycol, and polyhexamethylene adipate glycol; and lactone polyols such as polycaprolactone polyol. Examples of polyether polyols include poly(ethylene glycol), poly(propylene glycol), and poly(tetramethylene glycol).

The chain extender is not particularly limited, and a low molecular weight compound having, in the molecule, two or more active hydrogen atoms which can react with an isocyanate group and having a molecular weight of 2,000 or less may be used as the chain extender in the present invention. Of these, an aliphatic diol having 2 to 12 carbon atoms is preferable. Specific examples thereof include 1,4-butylene glycol, 1,2-ethylene glycol, 1,3-butanediol, 1,6-hexanediol, and 2,2-dimethyl-1,3-propanediol. Of these, 1,4-butylene glycol is particularly preferable.

The polyisocyanate compound is not particularly limited, and in the present invention, for example, one or more selected from the group consisting of 4,4'-diphenylmethane diisocyanate, 2,4-toluene diisocyanate, 2,6-toluene diisocyanate, p-phenylene diisocyanate, xylylene diisocyanate, naphthylene 1,5-diisocyanate, tetramethylxylene diisocyanate, hydrogenated xylylene diisocyanate, dicyclohexylmethane diisocyanate, tetramethylene diisocyanate, hexamethylene diisocyanate, isophorone diisocyanate, norbornene diisocyanate, trimethylhexamethylene diisocyanate, and dimer acid diisocyanate may be used. However, it is difficult to control the cross-linking reaction in injection molding for some isocyanate species, and thus, 4,4'-diphenylmethane diisocyanate, which is an aromatic diisocyanate, is preferable in the present invention from the viewpoint of the balance between stability in production and physical properties to be exhibited.

As the ionomer resin, it is possible to use a resin containing, as a base resin, the following component (a) and/or the following component (b), but the ionomer resin is not limited thereto. The following component (c) may be optionally added to the base resin. The component (a) is an olefin-unsaturated carboxylic acid-unsaturated carboxylic acid ester ternary random copolymer and/or a metal salt thereof; the component (b) is an olefin-unsaturated carboxylic acid binary random copolymer and/or a metal salt thereof; and the component (c) is a thermoplastic block copolymer having a crystalline polyolefin block and a polyethylene/butylene random copolymer.

A thermoplastic resin other than the thermoplastic polyurethane or an elastomer may be blended with the resin for the cover in addition to the thermoplastic polyurethane and the ionomer resin, which are the main components. More specifically, one or more selected from a polyester elastomer, a polyamide elastomer, an ionomer resin, a styrene block elastomer, a hydrogenated styrene butadiene rubber, a styrene-ethylene/butylene-ethylene block copolymer or a modified product thereof, an ethylene-ethylene/butylene-ethylene block copolymer or a modified product thereof, a styrene-ethylene/butylene-styrene block copolymer or a modified product thereof, an ABS resin, polyacetal, polyethylene, and a nylon resin may be used. In particular, it is preferable to use a polyester elastomer, a polyamide elastomer, and polyoxymethylene because resilience and abrasion resistance are improved due to reaction with the isocyanate group while maintaining excellent productivity. When the components mentioned above are blended, the amount to be blended is appropriately selected depending on the control of hardness, the improvement of resilience, the improvement of fluidity, the improvement of adhesiveness of the cover material, and the like. The amount to be blended is not particularly limited, and may be preferably at least 5 parts by mass based on 100 parts by mass of the thermoplastic polyurethane component. The upper limit of the amount to be blended is also not particularly limited, and may be preferably 100 parts by mass, more preferably 75 parts by mass, and further preferably 50 parts by mass based on 100 parts by mass of the thermoplastic polyurethane component. A polyisocyanate compound, fatty acid or a derivative thereof, a basic inorganic metal compound, a filler and the like may be added.

The lower limit of the thickness of the cover is preferably 0.2 mm, and more preferably 0.4 mm, and the upper limit thereof is preferably 4 mm, more preferably 3 mm, and further preferably 2 mm, while the thickness is not limited thereto.

The upper limit of the material hardness of the cover in terms of Shore D is preferably about 60 or less, more preferably about 55 or less, and further preferably about 50 or less; the lower limit of the material hardness of the cover in terms of Shore D is preferably about 35, and more preferably about 40, but the hardness is not limited thereto. For the material hardness of the cover, the resin material of the cover is formed into a sheet having a thickness of 2 mm, and the sheet is left for 2 weeks or more, and then Shore D hardness is measured according to the ASTM D2240-95 standard.

The coating layer is formed of a coating material containing a delusterant. The coating material is not particularly limited, and it is preferable to use, for example, a polyurethane coating material. It is more preferable to use a two-component curable polyurethane coating material.

Examples of delusterants include silica delusterants, melamine delusterants, and acrylic delusterants. Specific examples thereof include silica, polymethyl methacrylate, polybutyl methacrylate, polystyrene and polybutyl acrylate. The delusterant may be organic or inorganic. Silica is particularly preferably used.

When such a delusterant is included in the coating material layer, depressions are formed on the surface of the golf ball, and thus, the surface of the golf ball assumes a lusterless appearance. As a guide, when the surface of the golf ball has a surface roughness Ra of at least 0.35, an excellent matte appearance may be given to the surface of the golf ball. The surface roughness Ra means an arithmetic average roughness according to JIS B0601 (1994). The present inventors have found that when a coating layer is formed by using a coating material containing a delusterant, the static friction coefficient on the surface of the golf ball is significantly reduced to less than 0.20 compared to a coating layer formed by using a coating material not containing a delusterant, and the backspin rate of the golf ball in approach shots is significantly reduced. In other words, the present invention allows the static friction coefficient on the surface of the golf ball to be at least 0.20 even when the surface roughness on the surface of the golf ball is set to at least 0.35 by incorporating a delusterant into the coating layer.

In the present embodiment, the static friction coefficient on the surface of the golf ball can be at least 0.20 even when the surface roughness on the surface of the golf ball is set to at least 0.35 by using silica which has been subjected to hydrophilic surface treatment as a delusterant. Exposure of some of the silica which has been subjected to hydrophilic surface treatment on the surface of a golf ball allows depressions to be formed at the surface of the golf ball, and the hydrophilic surface improves the static friction coefficient at the surface of the golf ball.

It is preferable that the surface of the golf ball have a static friction coefficient of at least 0.24. The method for measuring the static friction coefficient will be described in detail in Examples. The upper limit of the static friction coefficient is not particularly limited, and it is, for example, preferably 0.40, more preferably 0.35, and further preferably 0.30.

Examples of silica which has been subjected to hydrophilic surface treatment include those under tradenames Nipsil SS-50B, SS-170X, SS-178B and SS-50A (manufactured by Tosoh Corporation). The present invention is not limited to using silica which has been subjected to hydrophilic surface treatment as a delusterant, and silica which has not been subjected to hydrophilic surface treatment may also be used. Examples of silica which has not been subjected to hydrophilic surface treatment include, for example, those under tradenames Nipsil E-200A, E-220A, K-500, E-1009, E-1011, E-1030, E-150J, E-170, E-200 and E-220 (manufactured by Tosoh Corporation). For example, when it is necessary to use a highly dispersible delusterant, silica which has not been subjected to hydrophilic surface treatment is preferred. Silica which has been subjected to hydrophilic surface treatment and silica which has not been subjected to hydrophilic surface treatment may be used in combination.

The amount of the delusterant to be blended is not particularly limited as long as the surface of the golf ball has a surface roughness Ra of at least 0.35, but it may be set to, for example, preferably 3 parts by mass or more, more preferably 5 parts by mass or more, and further preferably 7 parts by mass or more based on 100 parts by mass of the main agent (the total amount of resin component and solvent) in the coating material composition of the coating layer. It is preferable that the upper limit of the amount of the delusterant to be blended be 10 parts by mass or less because when the amount is excessive, the viscosity of the coating material composition tends to be increased, reducing workability of the coating.

Furthermore, in the present embodiment, by using a predetermined polyurethane coating material, the static friction coefficient on the surface of the golf ball can be at least 0.20 even when the surface roughness at the surface of the golf ball is set to at least 0.35 by using a delusterant.

First, a polyurethane coating material that is usually used will be described. The two-component curable polyurethane coating material is composed of polyol, which is the main agent, and polyisocyanate, which is a curing agent. It is preferable to use polycarbonate polyol and polyester polyol as polyol, but polyol is not limited thereto. Two polyester polyols, i.e., polyester polyol (A) and polyester polyol (B) may also be used. When these two polyester polyols are used, they have a different weight average molecular weight (Mw). It is preferable that the component (A) have a weight average molecular weight (Mw) of 20,000 to 30,000, and the component (B) have a weight average molecular weight (Mw) of 800 to 1,500. The component (A) has a weight average molecular weight (Mw) of more preferably 22,000 to 29,000, and further preferably 23,000 to 28,000. The component (B) has a weight average molecular weight (Mw) of preferably 900 to 1,200, and more preferably 1,000 to 1,100.

Polyester polyol is obtained by polycondensation between a polyol and a polybasic acid. Examples of polyols include diols such as ethylene glycol, 1,2-propanediol, 1,3-propanediol, 1,3-butanediol, 1,4-butanediol, 1,6-hexanediol, neopentylglycol, diethylene glycol, dipropylene glycol, hexylene glycol, dimethylolheptane, polyethylene glycol, and polypropylene glycol; triols; tetraols, and polyols having an alicyclic structure. Examples of polybasic acids include aliphatic dicarboxylic acids such as succinic acid, adipic acid, sebacic acid, azelaic acid, and dimer acid; aliphatic unsaturated dicarboxylic acids such as fumaric acid, maleic acid, itaconic acid, and citraconic acid; aromatic polybasic carboxylic acids such as phthalic acid, isophthalic acid, terephthalic acid, trimellitic acid, and pyromellitic acid; dicarboxylic acids having an alicyclic structure such as tetrahydrophthalic acid, hexahydrophthalic acid, 1,3-cyclohexanedicarboxylic acid, 1,4-cyclohexanedicarboxylic acid, and endomethylene tetrahydrophthalic acid; and tris-2-carboxyethyl isocyanurate. In particular, polyester polyol into which a cyclic structure has been introduced into the resin skeleton may be used as polyester polyol of the component (A). Examples thereof include polyester polyol obtained by polycondensation between a polyol having an alicyclic structure, such as cyclohexane dimethanol and a polybasic acid, or polyester polyol obtained by polycondensation between a polyol having an alicyclic structure and a diol or triol and a polybasic acid. In addition, a polyester polyol having a multibranched structure may be used as polyester polyol of the component (B). Examples thereof include polyester polyol having a branched structure such as "NIPPOLAN 800" manufactured by Tosoh Corporation.

When a polyester polyol as described above is used, the entirety of the main agent has a weight average molecular weight (Mw) of preferably 13,000 to 23,000, and more preferably 15,000 to 22,000. The entirety of the main agent has a number average molecular weight (Mn) of preferably 1,100 to 2,000, and more preferably 1,300 to 1,850. When these average molecular weights (Mw and Mn) are out of the range mentioned above, abrasion resistance of the coating layer may be reduced. The weight average molecular weight (Mw) and the number average molecular weight (Mn) are a measured value (in terms of polystyrene) in gel permeation chromatography (hereinafter, abbreviated as GPC) measurement based on detection by a differential refractive index meter. When two types of polyester polyols are used, the Mw and Mn of the entirety of the main agent are also within the range mentioned above.

The amounts of the two types of polyester polyols (A) and (B) to be blended are not particularly limited, and the amount of the component (A) to be blended is preferably 20 to 30% by mass based on the total amount of the main agent including the solvent, and the amount of the component (B) to be blended is preferably 2 to 18% by mass based on the total amount of the main agent.

The polyisocyanate is not particularly limited, and examples thereof include aromatic, aliphatic, and alicyclic polyisocyanates that are commonly used. Specific examples thereof include tolylene diisocyanate, diphenylmethane diisocyanate, xylylene diisocyanate, tetramethylene diisocyanate, hexamethylene diisocyanate (HDI), lysine diisocyanate, isophorone diisocyanate, 1,4-cyclohexylene diisocyanate, naphthalene diisocyanate, trimethylhexamethylene diisocyanate, dicyclohexylmethane diisocyanate, and 1-isocyanato-3,3,5-trimethyl-4-isocyanatomethylcyclohexane. These may be used alone or in a mixture.

Examples of modified products of hexamethylene diisocyanate (HDI) include polyester-modified products and urethane-modified products of HDI. Examples of derivatives of hexamethylene diisocyanate include an isocyanurate (nurate) form, biuret form, and adduct form of HDI. The adduct form refers to an adduct of diisocyanate and trimethylolpropane. The nurate form refers to a trimer of diisocyanate. In the present embodiment, by using two forms of HDIs, i.e., the adduct from having highly flexibility and the nurate form having relative rigidity in combination, the static friction coefficient at the surface of the golf ball can be set to at least 0.20, and excellent spin properties can be obtained in approach shots.

Since the static friction coefficient of the coating layer is increased when the amount of the adduct form is large, the ratio of mixing of the isocyanurate and adduct forms (isocyanurate form/adduct form) is preferably 90/10 or more, and more preferably 86/14 or more in mass ratio. In addition, when the amount of the adduct form is too great, the coating layer is easy to get dirty, and thus, in that case, the ratio of mixing is preferably 40/60 or less, and more preferably 50/50 or less.

Examples of the isocyanurate form of HDI include tradename Coronate 2357 (manufactured by Tosoh Corporation), Sumidule N3300 (manufactured by Sumika Covestro Urethane Co., Ltd.), Duranate TPA-100 (manufactured by Asahi Kasei Corporation), Takenate D170N, Takenate D177N (both manufactured by Mitsui Chemicals, Inc.) and Burnock DN-980 (manufactured by DIC). Examples of the adduct form of HDI include tradename Coronate HL (manufactured by Tosoh Corporation), Takenate D160N (manufactured by Mitsui Chemicals, Inc.), Duranate E402-80B, Duranate E405-70B (both manufactured by Asahi Kasei Corporation), and Burnock DN-955, Burnock DN-9555 (both manufactured by DIC).

In the urethane coating material composed of a polyol and a polyisocyanate, which are the main components, the lower limit of the molar ratio (NCO group/OH group) of the isocyanate group (NCO group) which the polyisocyanate has to the hydroxyl group (OH group) which the polyol has is preferably 0.6, and more preferably 0.65. The upper limit of the molar ratio is preferably 1.5, more preferably 1.0, and further preferably 0.9. When the molar ratio is less than the lower limit, unreacted hydroxyl groups may remain, and properties and water resistance of the coating layer may be deteriorated. In addition, when the molar ratio is greater than the upper limit, the amount of the isocyanate group is in excess, generating a (fragile) urea group due to reaction with water, and as a result, properties of the coating layer may be deteriorated.

An amine catalyst or an organometallic catalyst may be used as a curing catalyst (organometallic compound) which facilitates the reaction between polyol and polyisocyanate. Compounds which have been conventionally blended in a two-component curable urethane coating material as a curing agent, such as a metal soap of aluminum, nickel, zinc, tin or the like may be suitably used as the organometallic compound.

The coating layer may also contain a known additive as needed. More specifically, an appropriate amount of a water-repellent additive, a thickener, an ultraviolet absorber, a fluorescent brightener, or a pigment may be added thereto.

In the present embodiment, by reducing the content of the water-repellent additive added to the coating layer compared to that in usual cases, the surface energy of the coating layer (the surface of the golf ball) is increased, and thus, the static friction coefficient on the surface of the golf ball can be set to at least 0.20 and excellent spin properties can be obtained in approach shots even when the coating layer contains a delusterant. A higher surface energy improves spin properties of the golf ball. The surface energy is increased by using silica which has been subjected to hydrophilic surface treatment as a delusterant, whereas it is hardly increased when silica, which has not been subjected to hydrophilic surface treatment, is used. Thus, when silica which has not been subjected to hydrophilic surface treatment is used, the static friction coefficient at the surface of the golf ball can be set to at least 0.20 by increasing the surface energy based on the content of the water-repellent additive.

The surface of the golf ball has a surface energy of preferably 34 dyn or more, more preferably 40 dyn or more, and further preferably 44 dyn or more. When the upper limit of the surface energy is too high, the surface of the golf ball is easy to get dirty, and thus the upper limit is preferably 50 dyn or less, and more preferably 48 dyn or less. The surface energy may be measured by a method using dyne pens with 2 mN/m increments. The content of the water-repellent additive varies depending on the type of water-repellent additive, and the lower limit is preferably 0.02% by weight, and more preferably 0.05% by weight based on 100 parts by mass of the main agent (the total amount of the resin component and the solvent). The upper limit is preferably 1.0% by weight, and more preferably 0.7% by weight.

A silicone resin, a silicone oil, a silicone rubber, a fluorine surfactant or a combination thereof may be used as the water-repellent additive. Silicone-modified acrylate may be used as the silicone resin, but the silicone resin is not limited thereto. Silicone-modified acrylate is a surface conditioner in which an acrylic structure and a silicone structure are incorporated into a molecule. Since a polysiloxane chain is attached to the acrylic skeleton, slipping is unlikely to occur even when the amount to be added is increased, and thus water repellency can be increased, unlike in those using a usual polyrotaxane silicone. Examples of silicone-modified acylates include tradename BYK3550, BYK3700 (both manufactured by BYK-Chemie). Examples of silicone oils include methyl hydrogen silicone oil and dimethyl silicone oil.

For the thickness of the coating layer, the thickness in the central portion of the dimple of the cover is usually different from the thickness in the edge portion of the dimple. For this reason, an index called the edge ratio, which is the ratio of the thickness of the coating layer in the edge portion of the dimple to the thickness of the coating layer in the central portion of the dimple, is used. An edge ratio closer to 100% indicates that the thickness of the coating layer is uniform. In the present embodiment, flight distance in driver shots can be increased when the edge ratio is small, and thus, the edge ratio is preferably 70% or less, and more preferably 60% or less.

In addition, when the edge ratio is too small, the thickness in the edge portion of the coating layer is reduced, and thus, impact resistance is reduced and the coating layer easily peels off. For this reason, the lower limit of the edge ratio is preferably 40%, and more preferably 50%. More specifically, the thickness in the edge portion of the coating layer is preferably 5 μm or more, and more preferably 7 μm or more, from the viewpoint of scratch resistance and peeling resistance. In addition, an excessively thick coating layer affects aerodynamic characteristics of the golf ball, and thus, the upper limit of the thickness in the edge portion is preferably 20 μm, and more preferably 15 μm.

Next, the method for producing the golf ball of the present embodiment will be described. The method includes a step for forming a coating layer on the surface of a cover having a plurality of dimples.

The coating material composition used for forming a coating layer contains a coating material such as a polyurethane coating material, a delusterant, and an additive such as a water-repellent additive described above. In the coating material composition, the polyurethane coating material further includes a solvent used for each of polyol, which is the main agent, and polyisocyanate, which is a curing agent. Materials other than solvents have been described above, and thus will not be described in this section.

When a coating layer is to be formed on the recessed surface of a dimple, the thickness of the edge portion where the recess is shallow is usually small, and the thickness of the central portion where the recess is deep is large. In other words, although the edge ratio becomes less than 100%, flight distance can be increased when the edge ratio is less in the present embodiment as described above. It is preferable to use a solvent having a boiling point of at least 130° C. in order to form a coating layer having such a small edge ratio. A solvent having a higher boiling point allows the coating layer to be more easily leveled (smoothed) and is more likely to cause sagging of the coating material, improving flight distance. It is more preferable to use a solvent having a boiling point of at least 150° C. Examples of the solvents include propylene glycol monomethyl ether acetate (boiling point: 148° C.) and methoxybutyl acetate (boiling point: 171° C.).

The solvent has been described above, but the present invention is not limited thereto. A solvent having a boiling point of at least 130° C. and another solvent having a boiling point of less than 130° C. may be used in combination, or a solvent having a boiling point of less than 130° C. may be used alone. Examples of solvents having a boiling point of less than 130° C. include ester solvents such as methyl acetate (57° C.), ethyl acetate (77° C.), and butyl acetate (126° C.), hydrocarbon solvents such as n-hexane (68° C.), cyclohexane (80° C.) and benzene (80° C.) and ketone solvents such as acetone (56° C.) and methyl ethyl ketone (79° C.) (figures in parenthesis indicate boiling point). The amount to be blended of the solvent having a boiling point of at least 130° C. is preferably 5% by weight or more, and more preferably 10% by weight or more, based on the total mass of the coating material composition. The total mass of the coating material composition means the sum of the total mass of the main agent including the solvent and the total mass of the curing agent including the solvent.

The method for forming the coating layer is not particularly limited, and a known method for coating the surface of a cover with a coating material for golf balls may be used. For example, methods such as a spray coating method and an electrostatic coating method may be used. A coating layer can be formed on the surface of the cover by these methods.

After forming the coating layer, the step for drying the coating layer may be performed. The condition of drying may be the same as known conditions for drying a urethane coating material. In the present embodiment, the temperature of drying may be 40° C. or more, and in particular 40 to 60° C., and the time for drying may be 20 to 90 minutes, and in particular 40 to 50 minutes.

A coating layer having an average roughness Ra of at least 0.35 can be formed under these conditions, and a golf ball with a surface having a static friction coefficient of 0.20 can be formed. The method for producing a golf ball of the present embodiment may further include a step for forming a core and a step for forming a cover having a plurality of dimples on the outside of the core. These steps will be described.

A known method for molding a core of a golf ball may be used as the method for molding the core. For example, a core can be prepared by kneading the materials including a base material rubber described above using a kneading machine, and by subjecting the kneaded product to pressure vulcanization molding using a round mold, but the method is not limited thereto. A known method for molding a solid core having a multilayer structure may be used as a method for molding a core having a plurality of layers. For example, a center core is prepared by kneading materials using a kneading machine and subjecting the kneaded product to pressure vulcanization molding using a round mold; then materials for a surrounding layer are kneaded using a kneading machine, and the kneaded product is molded into a sheet; a center core is covered with the sheet; and the resulting product is subjected to pressure vulcanization molding with the round mold to prepare a multilayer core.

A known method for molding a cover of a golf ball may be used as a method for forming a cover. The method for forming a cover is not particularly limited, and for example, a core is placed in a mold, and a resin composition for a cover is injection molded to form a cover so that it covers the core. The mold for molding the cover has a plurality of protrusions for forming dimples at the surface of the cover. The size, the shape, and the number and the like of dimples formed on the surface of the cover may be appropriately designed according to desired aerodynamic properties of the golf ball.

EXAMPLES

Hereinafter Examples and Comparative Examples of the present invention will be described.

For the production of the golf balls of Examples and Comparative Examples, the coating layers of the golf ball were produced by using blends of coating materials shown in Table 1. The blends in Table 1 is shown in parts by mass. The thicknesses, the surface roughnesses, the static friction coefficients, and the surface energies of the coating layers of the prepared golf balls were measured, and the flight distances in driver shots and the spin rates in approach shots were measured.

As shown in the blends of the coating materials in Table 1, a polyester polyol having a weight average molecular weight (Mw) of 28,000 was used as the polyol, which was the main agent. This was synthesized by the following method. A reactor equipped with a reflux condenser, a dropping funnel, a gas introduction tube, and a thermometer was charged with 140 parts by mass of trimethylolpropane, 95 parts by mass of ethylene glycol, 157 parts by mass of adipic acid, and 58 parts by mass of 1,4-cyclohexanedimethanol, and the mixture was heated (allowed to react) at 200 to 240° C. for 5 hours while being stirred. Then, polyester polyols having an acid value of 4, a hydroxyl value of 170, and a weight average molecular weight (Mw) of 28,000 were prepared.

Ethyl acetate (boiling point: 77° C.), butyl acetate (boiling point: 126° C.), propylene glycol monomethyl ether acetate (abbreviated PGMEA) (boiling point 148° C.) and methoxybutyl acetate (abbreviated MBA) (boiling point 171° C.) were used as a solvent for the main agent.

Silica "Finesil X-35" manufactured by Maruo Calcium Co., Ltd. (average primary particle size: 2.4 μm, BET specific surface area: 262 $m^2/g$) (delusterant A) and hydrophilically surface-treated silica "SS-50A" manufactured by Tosoh Corporation (delusterant B) were used as a delusterant. Silicone-modified acrylate "BYK3700" manufactured by BYK-Chemie was used as an additive.

Furthermore, as shown in the blend of the coating material in Table 1, "Duranate TPA-100" manufactured by Asahi Kasei Corporation (NCO content: 23.1%, non-volatile content: 100%) which is the isocyanurate form of hexamethylene diisocyanate (HDI) and "Duranate E402-80B" manufactured by Asahi Kasei Corporation (NCO content: 7.6%, non-volatile content: 80%) which is the adduct form of HDI were used as the isocyanate of the curing agent of (solid content). Butyl acetate (boiling point: 126° C.) was used as a solvent for the curing agent.

Then coating materials prepared by mixing the main agent and the curing agent in proportions shown in Table 1 were applied to the cover by spray coating to form a coating layer, and the golf balls of Examples 1 to 6 and Comparative Examples 1 to 2 were prepared. The blend of the core and of the cover is the same in all of Examples and Comparative Examples.

Method for Measuring Thickness

The thickness of the central portion and the edge portion of a dimple of the coating layer in Table 1 was calculated by the following measurement method. First, in a cross section of a dimple 12 of a cover 10 shown in FIG. 1, 1 to 5 lines were drawn perpendicularly at regular intervals, and the lines were named as No. 1, No. 2, No. 3, No. 4, and No. 5, in that order, from the edge portion E of the dimple to the edge portion E' opposite thereto. The thickness of the coating layer 20 was measured for each of the lines. For the measurement of the thickness, the golf ball was cut and the thickness of the cross-section at each of the positions was measured by using a microscope. The average of the thicknesses in No. 1 and No. 5 was determined as the thickness of the edge portion of the dimple, and the average of the thicknesses in No. 2, No. 3, and No. 4 was determined as the thickness of the central portion of the dimple.

Then the edge ratio, which is the ratio of the thickness of the edge portion of the dimple to the thickness of the central portion of the dimple, was calculated by the following equation.

$$\text{Edge ratio}[\%]=(\text{thickness of edge portion})/(\text{thickness of central portion})\times 100$$

The thickness of the central portion, the thickness of the edge portion, and the edge ratio obtained are shown in Table 1.

Surface Roughness Ra

The surface roughness Ra of the surface (the surface of the coating layer) of the golf ball of the respective examples was measured by using surface roughness meter "SV-C3000" manufactured by Mitsutoyo Corporation. The sur-

TABLE 1

| | | | Examples | | | | | | Comparative Examples | |
|---|---|---|---|---|---|---|---|---|---|---|
| Coating material blending for coating layer | | | 1 | 2 | 3 | 4 | 5 | 6 | 1 | 2 |
| Main agent | Polyester polyol | | 23 | 23 | 23 | 23 | 23 | 23 | 23 | 23 |
| | Solvent | Ethyl acetate | 20 | 20 | 20 | 20 | 20 | 20 | 20 | 27 |
| | | Butyl acetate | 20 | 20 | 40 | 40 | 40 | 40 | 40 | 40 |
| | | PGMEA | — | 20 | — | — | — | — | — | — |
| | | MBA | 20 | — | — | — | — | — | — | — |
| | Delusterant | Delusterant A | — | — | — | 3.5 | 7 | 7 | 7 | — |
| | | Delusterant B | 7 | 7 | 7 | 3.5 | — | — | — | — |
| | Additive | Silicone-modified acrylate | 0.5 | 0.5 | 0.5 | 0.5 | 0.05 | 0.5 | 0.5 | 0.5 |
| Curing agent | Isocyanurate form of HDI | | 70 | 70 | 70 | 70 | 70 | 60 | 70 | 70 |
| | Adduct form of HDI | | — | — | — | — | — | 10 | — | — |
| | Solvent | Butyl acetate | 30 | 30 | 30 | 30 | 30 | 30 | 30 | 30 |
| Thickness of coating layer [μm] | | Central portion | 13.0 | 13.0 | 13.0 | 13.0 | 13.0 | 13.0 | 13.0 | 13.00 |
| | | Edge portion | 7.4 | 8.4 | 9.3 | 9.3 | 9.3 | 9.3 | 9.3 | 8.2 |
| | | Edge ratio | 57% | 64% | 72% | 72% | 72% | 72% | 72% | 63% |
| Surface roughness Ra | | | 0.40 | 0.40 | 0.40 | 0.40 | 0.40 | 0.40 | 0.40 | 0.09 |
| Gloss | | | None | None | None | None | None | None | None | Glossy |
| Static friction coefficient | | | 0.26 | 0.26 | 0.26 | 0.23 | 0.22 | 0.21 | 0.19 | 0.28 |
| Surface energy [mN/m] | | | 44 | 44 | 44 | 44 | 40 | 34 | 34 | 32 |
| Driver | Spin rate [rpm] | | 2620 | 2620 | 2620 | 2700 | 2720 | 2760 | 2790 | 2760 |
| | Elevation angle [°] | | 10.4 | 10.3 | 10.2 | 10.2 | 10.2 | 10.2 | 10.2 | 10.3 |
| | Carry distance [m] | | 214.5 | 214 | 213.5 | 213 | 213 | 212 | 212 | 216 |
| Approach | Spin rate [rpm] | | 5000 | 5000 | 5000 | 4600 | 4400 | 4400 | 4300 | 5200 |
| | Evaluation | | Very good | Very good | Very good | Very good | Good | Good | Poor | Very good |

face roughness Ra means an arithmetic average roughness according to JIS B0601 (1994). The results are shown in Table 1.

Gloss

The gloss of the surface of the golf ball (coating layer) was evaluated as follows. The degree of gloss was measured at an incident angle of measurement of 20°/60°/85° using a "Micro-TRI-gloss" manufactured by BYK. For the numerical value of the degree of gloss at each angle of measurement, if a degree of gloss at 20° was 5.0 or less, a degree of gloss at 60° was 20.0 or less, and a degree of gloss at 85° was 40.0 or less suggested that the gloss was sufficiently suppressed, and such a case was rated as "none." Cases other than these were rated as "glossy." The results are shown in Table 1.

Static Friction Coefficient

A golf ball of each of the examples was placed on a face plate (stainless steel), and a load was applied to the golf ball (normal force: 3.5 N) to move the ball using a tester "Tensilon RTG1310" manufactured by A & D Company, Limited, under conditions of a temperature of 23° C. and a tensile speed of 50 mm/min, and the friction force (unit: N) was measured. The static friction coefficient μ was calculated by the following equation. F refers to friction force, and N refers to normal force. The results are shown in Table 1.

$$\mu = F/N$$

Surface Energy 8 test pens (dyne pens) having a surface energy of 30 to 44 mN/m with 2 mN/m increments manufactured by Mishima Co., Ltd., were used. A line was drawn with the test pens on a surface of a golf ball (coating layer) to apply ink in the form of a line. A case in which the ink adhered to the surface of the ball did not form a droplet and was held for 2 seconds or more, was determined to have maintained the surface energy of the test pen on the coating layer. By using test pens, each having a different surface energy, the surface energy of the coating layer was determined. The results are shown in Table 1.

Spin Rate, Elevation Angle, and Flight Distance in Driver Shots

Figure 2:
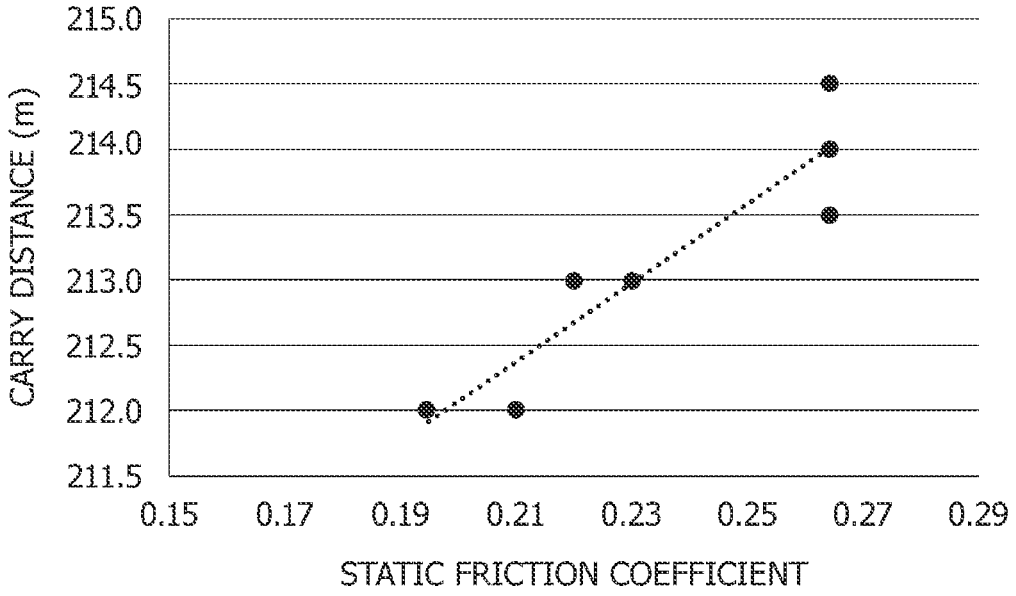
FIG. 2 is a graph showing the relationship between the static friction coefficient and the carry distance in driver shots measured in Examples.

The spin (backspin) rates, the elevation angles, and the flight distances (carry) when a ball was hit by a club attached to a golf robot at a head speed of 45 m/s were measured. A driver "JGR (2016 Model) loft angle 9.5" manufactured by Bridgestone Sports Co., Ltd., was used as the club. The spin rate, the elevation angle, and the carry distance obtained are shown in Table 1. Furthermore, the relationships between the static friction coefficient and the carry distance are shown in FIG. 2.

Spin Rate in Approach Shots

Figure 3:
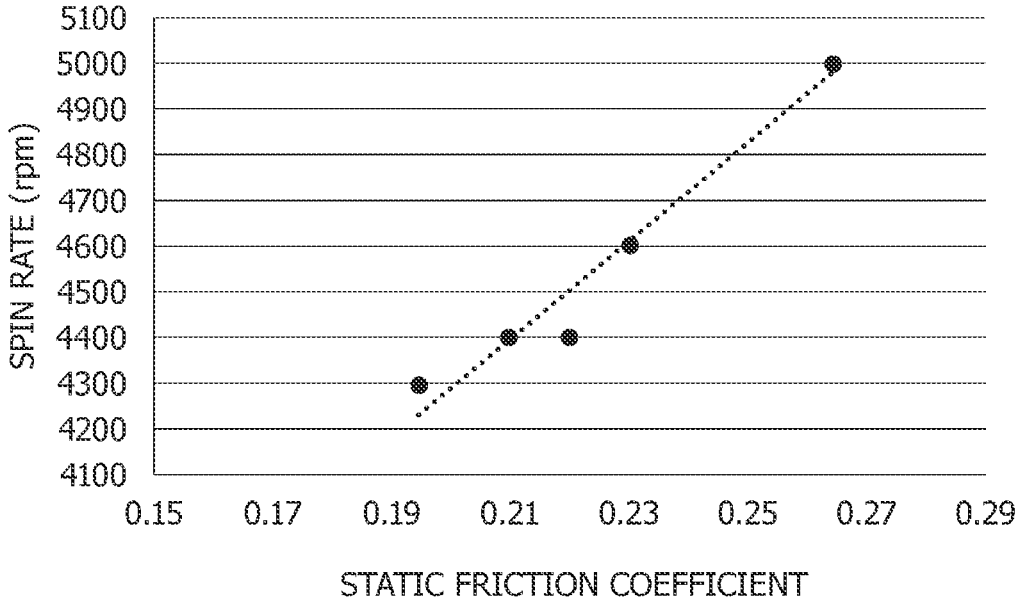
FIG. 3 is a graph showing the relationship between the static friction coefficient and the spin rate in approach shots measured in Examples.

The spin (backspin) rate when a ball was hit by a club attached to a golf robot at a head speed of 20 m/s was measured and evaluated. Sand wedge (SW) "Tour B XW-1 SW" manufactured by Bridgestone Sports Co., Ltd., was used as the club. Cases in which the spin rate was 4,600 rpm or more were rated as "very good," cases in which the spin rate was 4,400 rpm or more were rated as "good," and cases in which the spin rate was less than that were rated as "poor." The spin rate obtained and the results of evaluation are shown in Table 1. Furthermore, the relationships between the static friction coefficient and the spin rate are shown in FIG. 3.

As shown in Table 1, although the golf ball of Comparative Example 1, having a coating layer formed by using a conventional delusterant which had not been surface-treated has a matte appearance without gloss compared with the golf ball of Comparative Example 2 having a coating layer formed without using a delusterant, the static friction coefficient of the golf ball of Comparative Example 1 was significantly reduced from 0.28 to 0.19. Furthermore, not only was the spin rate in approach shots significantly reduced, but also the flight distance in driver shots was reduced.

In addition, the golf balls of Examples 1 and 2 having a coating layer formed by using a delusterant which had been subjected to hydrophilic surface treatment and a solvent having high boiling point as a solvent for the main agent had a matte appearance without gloss, and the static friction coefficient thereof increased to 0.26, which is closer to that of Comparative Example 2, and the spin rate in approach shots and the flight distance in driver shots were also increased to the same level as those in Comparative Example 2.

The golf ball of Example 3 having a coating layer formed by using a delusterant which had been subjected to hydrophilic surface treatment and a solvent with the same blending as Comparative Example 1 had a matte appearance without gloss, and the static friction coefficient thereof was increased to 0.26, which is closer to that of Comparative Example 2, and the spin rate in approach shots was also increased to the same level as that in Comparative Example 2.

The golf ball of Example 4 having a coating layer formed by using a delusterant which had been subjected to hydrophilic surface treatment and a conventional delusterant which had not been subjected to hydrophilic surface treatment in the same amount and using a solvent with the same blending as Comparative Example 1 had a matte appearance without gloss, and the static friction coefficient thereof was increased to 0.23. The spin rate in approach shots was higher than that of Comparative Example 1.

The golf ball of Example 5 having a coating layer formed by using a delusterant which had not been subjected to hydrophilic surface treatment as in Comparative Example 1 and using silicone-modified acrylate, which was a water-repellent additive, in an amount equal to one tenth of that in Comparative Example 1 had a matte appearance without gloss. The surface energy of the golf ball was as high as 40 dyn and the static friction coefficient was also increased to 0.22. The spin rate in approach shots was also higher than that of Comparative Example 1.

The golf ball of Example 6 having a coating layer formed by using a delusterant which had not been subjected to hydrophilic surface treatment as in Comparative Example 1 and using not only the isocyanurate form of HDI, but also the adduct form of HDI, were used in a mixture as a curing agent had a matte appearance without gloss. The static friction coefficient thereof was also increased to 0.21. The spin rate in approach shots was also higher than that of Comparative Example 1.

As shown in FIG. 3, the results of Examples 1 to 6 and Comparative Examples 1 and 2 show that when the surface of the golf ball had a higher coefficient of static friction, the spin rate in approach shots increased. It was found that a sufficient spin rate can be obtained in approach shots by setting the static friction coefficient of the surface of the golf ball to 0.20 or more.

Furthermore, as shown in FIG. 2, the results of Examples 1 to 6 and Comparative Examples 1 and 2 show that when the surface of the golf ball had a high static friction coefficient, the flight resistance in driver shots increased. The tendency is also found even excluding the results of Examples 1 and 2 in which the edge ratio was reduced in order to increase the flight resistance. These results of increased flight distance seem to be due to an increased coefficient of friction between the ball and the club, which causes low spin in driver shots. As described above, it has been found that increasing the static friction coefficient at the surface of the golf ball improves flight distance in driver shots.

What is claimed is:

1. A golf ball comprising:

a core;

a cover located outside the core and having a plurality of dimples; and a coating layer located outside the cover and containing a delusterant, a surface of the coating layer having an average roughness Ra of at least 0.35, wherein a surface of the golf ball has a static friction coefficient of at least 0.20, which is obtained by (i) the delusterant comprising silica having a hydrophilic treated surface;

(ii) the coating layer comprising water-repellent additive in an amount sufficient so that the surface of the golf ball has a surface energy of at least 40 dyn.

2. The golf ball according to claim 1, wherein the surface of the golf ball has a static friction coefficient of at least 0.24.

3. The golf ball according to claim 1, wherein the coating layer has an edge ratio of up to 70%, the edge ratio being a ratio of a thickness of the coating layer in an edge portion of a dimple to a thickness of the coating layer in a central portion of the dimple.

4. The golf ball according to claim 1, wherein the coating layer comprises a urethane coating material, and the urethane coating material comprises polyisocyanate as a curing agent, and the polyisocyanate comprises both an adduct form and an isocyanurate form of hexamethylene diisocyanate.

* * * * *